US010822685B2

(12) United States Patent
Sato et al.

(10) Patent No.: US 10,822,685 B2
(45) Date of Patent: Nov. 3, 2020

(54) HOT-DIP AL ALLOY COATED STEEL SHEET AND METHOD OF PRODUCING SAME

(71) Applicant: JFE STEEL CORPORATION, Tokyo (JP)

(72) Inventors: Rinta Sato, Tokyo (JP); Shunsuke Yamamoto, Tokyo (JP); Satoru Ando, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 16/489,848

(22) PCT Filed: Mar. 27, 2018

(86) PCT No.: PCT/JP2018/012570
§ 371 (c)(1),
(2) Date: Aug. 29, 2019

(87) PCT Pub. No.: WO2018/181392
PCT Pub. Date: Oct. 4, 2018

(65) Prior Publication Data

US 2020/0032381 A1 Jan. 30, 2020

(30) Foreign Application Priority Data

Mar. 31, 2017 (JP) ..... 2017-072415
Feb. 20, 2018 (JP) ..... 2018-028208

(51) Int. Cl.
*C23C 2/12* (2006.01)
*C22C 21/08* (2006.01)
(Continued)

(52) U.S. Cl.
CPC ..... *C23C 2/12* (2013.01); *C22C 21/08* (2013.01); *C23C 2/28* (2013.01); *C23C 2/40* (2013.01); *Y10T 428/12757* (2015.01)

(58) Field of Classification Search
None
See application file for complete search history.

(56) References Cited

U.S. PATENT DOCUMENTS 6,649,282 B1 * 11/2003 Yamaguchi ..... C22C 13/00 428/621
9,493,868 B2 11/2016 Tsuru et al.
(Continued)

FOREIGN PATENT DOCUMENTS

EP 2792764 A1 10/2014
JP 2000239820 A 9/2000
(Continued)

OTHER PUBLICATIONS

Feb. 27, 2020, the Extended European Search Report issued by the European Patent Office in the corresponding European Patent Application No. 18776826.2.
(Continued)

*Primary Examiner* — Daniel J. Schleis
(74) *Attorney, Agent, or Firm* — Kenja IP Law PC

(57) ABSTRACT

To provide a hot-dip Al alloy coated steel sheet which is excellent in post-painting corrosion resistance and post-working corrosion resistance. Disclosed is a hot-dip Al alloy coated steel sheet comprising a coating formed by a coating layer and an interfacial alloy layer present at an interface between the coating layer and a base steel sheet, in which the interfacial alloy layer contains Mn, and the coating layer contains $Mg_2Si$ having a major axis length of 5 μm or more.

6 Claims, 3 Drawing Sheets

| point | Mg(wt%) | Al(wt%) | Si(wt%) | Mn(wt%) | Fe(wt%) |
|---|---|---|---|---|---|
| 1 | 6.4 | 84.9 | 7.6 | 0.0 | 1.1 |
| 2 | 63.0 | 0.6 | 35.4 | 0.0 | 1.0 |
| 3 | 0.9 | 56.9 | 10.0 | 7.9 | 24.3 |

(51) Int. Cl.
*C23C 2/28* (2006.01)
*C23C 2/40* (2006.01)

(56) References Cited

U.S. PATENT DOCUMENTS

| | | | | |
|---|---|---|---|---|
| 2009/0142616 | A1 | 6/2009 | Fujii | |
| 2014/0377583 | A1* | 12/2014 | Tsuru | C21D 8/0478 428/653 |

FOREIGN PATENT DOCUMENTS

| | | | |
|---|---|---|---|
| JP | 4199404 | B2 | 12/2008 |
| JP | 2012007245 | A | 1/2012 |
| JP | 5430022 | B2 | 2/2014 |
| WO | 2007029322 | A1 | 3/2007 |
| WO | 2012165838 | A2 | 12/2012 |

OTHER PUBLICATIONS

Sep. 3, 2019, Notification of Reasons for Refusal issued by the Japan Patent Office in the corresponding Japanese Patent Application No. 2018-028208 with English language Concise Statement of Relevance.

May 29, 2018, International Search Report issued in the International Patent Application No. PCT/JP2018/012570.

Mar. 31, 2020, Official Decision of Refusal issued by the Japan Patent Office in the corresponding Japanese Patent Application No. 2018-028208 with English language concise statement of relevance.

* cited by examiner

| point | Mg(wt%) | Al(wt%) | Si(wt%) | Mn(wt%) | Fe(wt%) |
|---|---|---|---|---|---|
| 1 | 6.4 | 84.8 | 7.6 | 0.0 | 1.1 |
| 2 | 63.0 | 0.6 | 35.4 | 0.0 | 1.0 |
| 3 | 0.9 | 56.9 | 10.0 | 7.9 | 24.3 |

HOT-DIP AL ALLOY COATED STEEL SHEET AND METHOD OF PRODUCING SAME

TECHNICAL FIELD

This disclosure relates to a hot-dip Al alloy coated steel sheet which is excellent in post-painting corrosion resistance and post-working corrosion resistance, and a method of manufacturing the same.

BACKGROUND

As coated steel material excellent in corrosion resistance and high-temperature oxidation resistance, Al alloy coated steel sheets are widely used in the field of automobile muffler materials and building materials.

However, although Al alloy coated steel sheets exhibit excellent corrosion resistance as they stabilize corrosion products in an environment with low chloride ion concentration and in a corrosive environment under dry conditions, they have the problem of not being able to exhibit sufficient corrosion resistance in an environment where they are exposed to chlorides for a long period of time in wet conditions such as deicing salt scattered areas. Long exposure to chlorides in a wet state causes the coating elution rate to be extremely fast, which easily leads to corrosion of the base steel sheet. In addition, when an Al alloy coated steel sheet is painted and used, the lower part of the painting layer is in an alkaline atmosphere, the corrosion rate of Al is increased, which causes a problem of blistering of the painting layer.

Therefore, various techniques have been developed for the purposes of improving the corrosion resistance of hot-dip Al alloy coated steel sheets and the post-painting corrosion resistance.

For example, JP2000-239820A (PTL 1) describes a hot-dip aluminum alloy coated steel sheet comprising: an intermetallic compound coating layer provided on a surface of a steel sheet, containing Al, Fe, and Si, and having a thickness of 5 μm or less; and a coating layer provided on a surface of the intermetallic compound coating layer and containing, by wt %, Si: 2% to 13% and Mg: more than 3% to 15%, with the balance substantially consisting of Al.

JP4199404B (PTL 2) describes a hot-dip Al-based coated steel sheet having good corrosion resistance, comprising: a hot-dip Al—Mg—Si-based coating layer formed on a surface of a steel sheet and containing, by wt %, Mg: 3% to 10% and Si: 1% to 15%, with the balance being Al with inevitable impurities, wherein the coating layer has a metallic structure composed of at least an Al phase and an $Mg_2Si$ phase, and the $Mg_2Si$ phase has a major axis length of 10 μm or less.

Furthermore, JP5430022B (PTL 3) describes an Al alloy coated steel sheet comprising: a coating layer formed on a surface of a steel material, the coating layer containing Mg: 6 mass % to 10 mass %, Si: 3 mass % to 7 mass %, Fe: 0.2 mass % to 2 mass %, and Mn: 0.02 mass % to 2 mass %, with the balance being Al and inevitable impurities, wherein the coating layer has an αAl-$Mg_2Si$—(Al—Fe—Si—Mn) pseudo ternary eutectic structure which has an area ratio of 30% or more.

CITATION LIST

Patent Literature

PTL 1: JP2000-239820A
PTL 2: JP4199404B
PTL 3: JP5430022B

SUMMARY

Technical Problem

However, the technique of PTL 1 has a problem in that an $Al_3Mg_2$ phase precipitates in the coating layer, promoting localized dissolution of the coating layer.

In addition, the technique of PTL 2 has a problem in that a long and narrow needle-like or plate-like Al—Fe compound precipitates in the coating layer, promoting, as a local cathode, local dissolution of the coating layer. Furthermore, the technique of PTL 3, as a result of an Al—Fe compound being taken into the eutectic structure by the addition of Mn, it is possible to achieve further improvement in corrosion resistance, including prevention of local corrosion resistance deterioration. However, when a painting layer is provided on a hot-dip Al alloy coated steel sheet, the lower part of the painting layer is in an alkaline/low-oxygen environment, and the coating layer forms a galvanic pair with a portion of the base steel sheet that has a nobler potential where the coating layer is exposed due to the presence of a scar or the like. As a result, although the base steel sheet is subjected to sacrificial protection, the corrosion rate of the coating layer is extremely increased, and there is a possibility that blisters may occur. Therefore, further improvement is desired for the corrosion resistance after provision of a painting layer (hereinafter referred to as "post-painting corrosion resistance").

Further, in a hot-dip Al alloy coated steel sheet, an alloy layer (interfacial alloy layer) mainly composed of Al and Fe is usually formed at the interface between the coating layer and the base steel sheet. This interfacial alloy layer is harder than the coating layer which is the upper layer, and provides a starting point of cracks during working, leading to a decrease in workability, and the base steel sheet is exposed from the generated cracked parts, causing deterioration of corrosion resistance after working (hereinafter referred to as "post-working corrosion resistance"). Therefore, in addition to the requirement for improvement of the post-painting corrosion resistance, there is a demand for development of a hot-dip Al alloy coated steel sheet that has further improved post-working corrosion resistance.

It would thus be helpful to provide a hot-dip Al alloy coated steel sheet which is excellent in post-painting corrosion resistance and post-working corrosion resistance, and a method of producing the hot-dip Al alloy coated steel sheet.

Solution to Problem

As a result of intensive studies to solve the above problems, the inventors paid attention to the fact that by increasing, rather than reducing, the size of $Mg_2Si$ in coating, which has been believed to be the starting point of corrosion, an effect of suppressing painting layer blistering (a post-painting corrosion resistance improving effect) can be obtained. Although the mechanism is not clear, $Mg_2Si$, which has been made large-grained and located near the coating surface, dissolves almost simultaneously with the dissolution of the α-Al phase that occurs from the coating surface in a corrosive environment, resulting in production of a corrosion product in which Mg and Si concentrate. Since this corrosion product has an effect of suppressing the corrosion of coating, it is presumed that a post-painting corrosion resistance improving effect is obtained. Then, the inventors conducted intensive studies and found that $Mg_2Si$ having a large grain size (having a major axis length of more than 5 μm) can be formed in the coating by containing required amounts of Mg and Si. The inventors also found that the thickness of the interfacial alloy layer can be kept small by containing a required amount of Mn in the interfacial alloy layer present at the interface between the coating layer and the base steel sheet, and at the same time, as a result of being able to modify the composition of the interfacial alloy layer to the one different from the conventional one, it becomes possible to improve workability and provide excellent post-working corrosion resistance.

The present disclosure was completed based on these findings, and primary features thereof are as described below.

1. A hot-dip Al alloy coated steel sheet comprising a coating formed by a coating layer and an interfacial alloy layer present at an interface between the coating layer and a base steel sheet, wherein the interfacial alloy layer contains Mn, and the coating layer contains $Mg_2Si$ having a major axis length of 5 μm or more.

2. The hot-dip Al alloy coated steel sheet according to 1., wherein the interfacial alloy layer further contains Al, Fe, and Si.

3. The hot-dip Al alloy coated steel sheet according to 1. or 2., wherein the content of Mn in the interfacial alloy layer is 5 mass % to 30 mass %.

4. The hot-dip Al alloy coated steel sheet according to any one of 1. to 3., wherein the coating layer is formed using a coating bath in a coating apparatus containing (consisting of) Mg: 6 mass % to 15 mass %, Si: more than 7 mass % and 20 mass % or less, and Mn: more than 0.5 mass % and 2.5 mass % or less, with the balance being Al and inevitable impurities.

5. The hot-dip Al alloy coated steel sheet according to 4., wherein the coating layer is formed by passing the base steel sheet through the coating bath and then cooling the base steel sheet at a cooling rate of less than 15 K/s.

6. The hot-dip Al alloy coated steel sheet according to 4. or 5., wherein the coating bath has a composition that satisfies the following relationship:

$$\mathrm{MIN}\{\mathrm{Si}\ \%\times([\mathrm{Mg_2Si}]_{mol}/[\mathrm{Si}]_{mol}),\mathrm{Mg}\ \%\times([\mathrm{Mg_2Si}]_{mol}/(2\times[\mathrm{Mg}]_{mol}))\}/\mathrm{Al}\ \%>0.13, \quad \text{Expression (1):}$$

where M % denotes a concentration by mass % of element M, $[M]_{mol}$ denotes a molar mass of element M, and MIN(a, b) denotes any one of a and b, whichever is smaller.

7. The hot-dip Al alloy coated steel sheet according to any one of 1. to 6., wherein the coating has a thickness of 10 μm to 35 μm.

8. A method of producing a hot-dip Al alloy coated steel sheet, the method comprising using a coating bath in a coating apparatus containing Mg: 6 mass % to 15 mass %, Si: more than 7 mass % and 20 mass % or less, and Mn: more than 0.5 mass % and 2.5 mass % or less, with the balance being Al and inevitable impurities.

9. The method of producing a hot-dip Al alloy coated steel sheet according to 8., comprising: passing the base steel sheet through the coating bath; and then cooling the base steel sheet at a cooling rate of less than 15 K/s.

Advantageous Effect

According to the present disclosure, it is possible to provide a hot-dip Al alloy coated steel sheet which is excellent in post-painting corrosion resistance and post-working corrosion resistance, and a method of producing the hot-dip Al alloy coated steel sheet.

DETAILED DESCRIPTION

Figure 1:
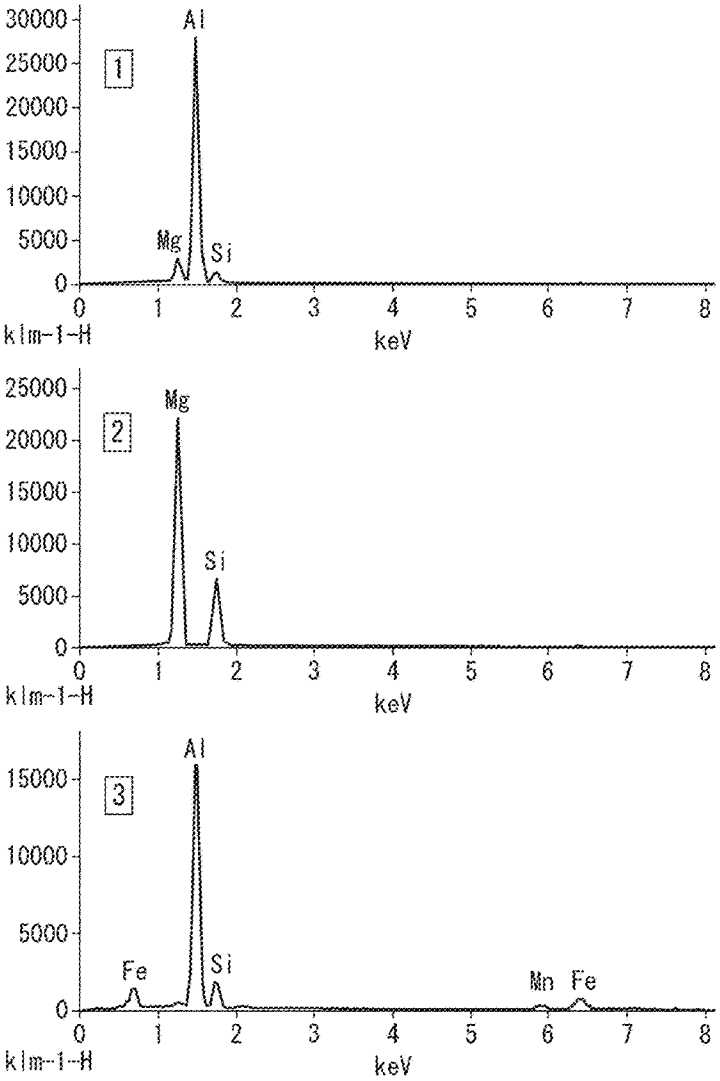
FIG. 1 is a diagram illustrating a SEM image of a cross section of a coating and a SEM-EDX profile of a hot-dip Al alloy coated steel sheet according to an embodiment of the present disclosure.
Figure 1:
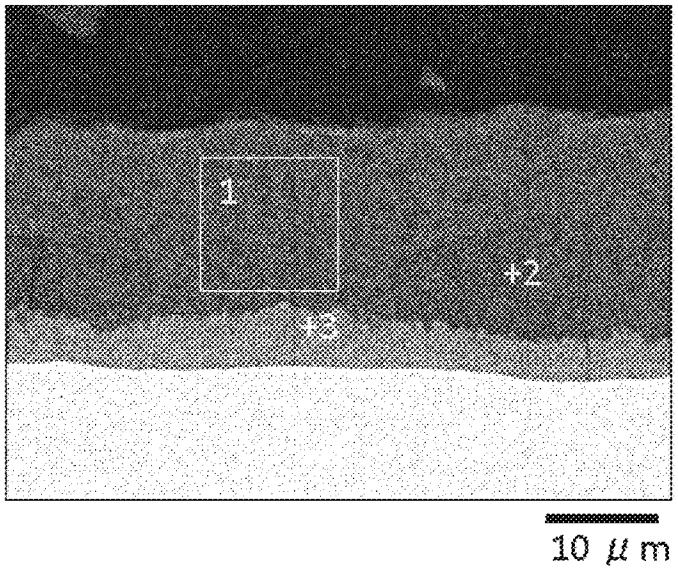

The following describes the present disclosure in detail.

(Hot-Dip Al Alloy Coated Steel Sheet)

The hot-dip Al alloy coated steel sheet disclosed herein comprises a coating (hereinafter also expressed simply as "the coating") composed of a coating layer and an interfacial alloy layer present at an interface between the coating layer and a base steel sheet.

The coating layer and the interfacial alloy layer can be observed under a scanning electron microscope or the like for a cross section of the hot-dip Al alloy coated steel sheet that has been polished and/or etched. Although there are several types of polishing methods and etching methods for cross sections, no particular limitations are placed on these methods as long as they are generally used when observing cross sections of a coated steel sheet. Further, regarding the observation conditions using a scanning electron microscope, it is possible to clearly observe the coating layer and the interfacial alloy layer, for example, in reflected electron images at a magnification of 1000 times or more, with an acceleration voltage of 15 kV.

The present disclosure is characterized in that the interfacial alloy layer contains Mn, and the coating layer contains $Mg_2Si$ having a major axis length of 5 μm or more.

When the interfacial alloy layer contains Mn, the potential of the interfacial alloy layer becomes less-noble and approaches the potential of the coating layer, with the result that the dissolution of the coating layer caused by the corrosion due to contact between different types of metals having different properties is alleviated, and the post-painting corrosion resistance can be improved. Moreover, by incorporating Mn into the interfacial alloy layer, the thickness of the interfacial alloy layer can be kept small, and as a result, the workability can also be improved. Furthermore, it is possible to greatly improve the post-painting corrosion resistance when the base steel sheet is exposed as a result of formation of large-grained $Mg_2Si$ having a major axis length of 5 μm (hereinafter also referred to as "massive $Mg_2Si$ grains") in the coating layer.

The effect of improving the post-painting corrosion resistance by massive $Mg_2Si$ grains contained in the coating layer is particularly seen by such grains that have a large grain size, specifically, large-grained $Mg_2Si$ having a major axis length of more than 5 μm. Therefore, in the present disclosure, the major axis length of $Mg_2Si$ in the coating layer is more than 5 μm, preferably 10 μm or more, and more preferably 15 μm or more.

As used herein, the "major axis length of $Mg_2Si$" refers to the diameter of an $Mg_2Si$ grain having the longest diameter among all the $Mg_2Si$ grains present in the observation field of view when observing $Mg_2Si$ grains in a cross section of the coating layer using a scanning electron microscope. In addition, the phrase "contains $Mg_2Si$ having a major axis length of 5 μm or more" means that in a cross section in the sheet thickness direction of the coating layer, one or more grains have a major axis length of 5 μm or more are present in every observation field of view when observing a range of 1 mm in length in the sheet transverse direction with a scanning electron microscope. Note that with regard to the feature that the coating layer "contains $Mg_2Si$ having a major axis length of more than 5 μm", this condition can be met in any cross section (except the interfacial alloy layer) of the coating even when randomly observed in the hot-dip Al alloy coated steel sheet disclosed herein.

Further, the number of $Mg_2Si$ having a major axis length of more than 5 μm is preferably 5 or more. If the number of $Mg_2Si$ having a major axis length of more than 5 μm is 5 or more in a range of 1 mm in length in the sheet transverse direction in a cross section in the sheet thickness direction of the coating layer, it is considered that there is a sufficient amount of $Mg_2Si$ for suppressing painting layer blistering caused by a scar reaching the base steel sheet. On the other hand, if the number of such $Mg_2Si$ is four or less, exposure of $Mg_2Si$ at the scar may be insufficient to exert a sufficient effect.

Moreover, regarding $Mg_2Si$ contained in the coating layer, it is preferable that the area ratio of $Mg_2Si$ having a major axis length of more than 5 μm is 2% or more, more preferably 3% or more, and particularly preferably 5% or more, in a cross section in the sheet thickness direction of the coating layer.

As described above, large-grained $Mg_2Si$ suppresses the selective corrosion of interdendrite and contributes to the improvement of the post-painting corrosion resistance. Therefore, by setting the area ratio of $Mg_2Si$ having a major axis length of more than 5 μm to 2% or more, even better post-painting corrosion resistance can be obtained.

However, if the proportion of large-grained $Mg_2Si$ is excessively large, coating cracking is likely to occur when bending the steel sheet, causing deterioration of the bending workability of the steel sheet. Therefore, the upper limit for the area ratio of $Mg_2Si$ having a major axis length of more than 5 μm is preferably about 10%.

Note that the area ratio of $Mg_2Si$ in the present disclosure is determined by a method including, but is not limited to, for example, mapping a cross section of the coating of an Al alloy coated steel sheet with SEM-EDX, and deriving, by image processing, an area ratio (%) obtained by dividing the area of a portion in which Mg and Si are detected in an overlapping relationship in one field of view (i.e., $Mg_2Si$ is present) by the area of the coating (observation field of view).

Further, $Mg_2Si$ having a major axis length of 5 μm or more formed in the coating layer preferably has a nearest neighbor distance of 0.5 μm or more to the surface of the coating layer. The reason is that the large-grained $Mg_2Si$ exposed to the outermost surface of the coating serves as a starting point of local corrosion in the chemical conversion treatment step to be carried out as a pre-painting treatment, and also reduces the corrosion resistance or painting layer adhesion after the painting.

As used herein, the nearest neighbor distance between $Mg_2Si$ having a major axis length of 5 μm or more and the surface of the coating layer refers to the distance of a portion at which the distance between $Mg_2Si$ having a major axis length of 5 μm or more and the surface of the coating layer is the closest in the observation field of view when observing a cross section of a hot-dip Al alloy coated steel sheet under a scanning electron microscope. In the present disclosure, it is preferable that the nearest neighbor distance between $Mg_2Si$ having a major axis length of 5 μm or more and the surface of the coating layer is 0.5 μm or more, regardless of which part of the coating layer is measured.

The interfacial alloy layer of the hot-dip Al alloy coated steel sheet disclosed herein contains Mn, as described above, in an amount of preferably 5 mass % to 30 mass %. The reason is that better post-painting corrosion resistance and post-working corrosion resistance can be achieved. In addition, the interfacial alloy layer further contains Al, Fe, and Si, and the concentrations thereof are preferably Al: 30 mass % to 90 mass %, Fe: 5 mass % to 70 mass %, and Si: 0 mass % to 10 mass %. By further containing Al, Fe, and Si in the above-mentioned concentration ranges in the interfacial alloy layer, it becomes possible to contain $Fe_2Al_5$, $Fe_4Al_{13}$ and α-Al(Fe, Mn)Si as crystal components, and $Fe_2Al_5$, $Fe_4Al_{13}$ and α-Al(Fe, Mn)Si forms a three-layer structure, i.e., (the base steel sheet)/$Fe_2Al_5$/$Fe_4Al_{13}$/α-Al(Fe, Mn)Si/(the coating layer), in the interfacial alloy layer such that the least-noble α-Al(Fe, Mn)Si is located immediately below the coating layer. As a result, it is possible to further slow down the galvanic corrosion of the coating layer, and to provide even better post-painting corrosion resistance and post-working corrosion resistance.

FIG. 1 illustrates an SEM image of a cross section of the coating and an example of an SEM-EDX profile for a hot-dip Al alloy coated steel sheet according to an embodiment of the present disclosure. As can be seen from FIG. 1, the coating of the Al alloy coated steel sheet has a $Mg_2Si$ phase having a major axis length of 5 μm or more, and an interfacial alloy layer containing Mn. Also, it can be seen that Mn is substantially absent in the coating layer and localized in the interfacial alloy layer.

Furthermore, in the hot-dip Al alloy coated steel sheet disclosed herein, the coating layer and the interfacial alloy layer can be formed using a coating bath in a coating apparatus containing Mg: 6 mass % to 15 mass %, Si: more than 7 mass % and 20 mass % or less, and Mn: more than 0.5 mass % and 2.5 mass % or less, with the balance being Al and inevitable impurities. The reason is that $Mg_2Si$ having a major axis length of 5 μm or more can be more reliably formed in the coating layer obtained by the above method, and Mn can be more reliably incorporated into the interfacial alloy layer.

Note that the composition of the coating layer of the hot-dip Al alloy coated steel sheet disclosed herein is substantially the same as that of the coating bath. Therefore, the composition of the coating layer can be accurately controlled by controlling the composition of the coating bath. Further, the composition of the interfacial alloy layer formed by the reaction of the coating bath and the steel sheet can also be accurately controlled by controlling the composition of the coating bath.

As described above, the coating bath contains Mg in an amount of 6 mass % to 15 mass %. The Mg contained in the coating bath is mainly distributed to the coating layer in the solidification process, and as a result of being able to form the above-described large-grained $Mg_2Si$, it contributes to the improvement of the post-painting corrosion resistance. Here, when the Mg content is less than 6 mass %, a sufficient amount of large-grained $Mg_2Si$ can not be formed, fracture of an Al oxide film which can suppress selective corrosion of interdendrite will not occur, and thus the post-painting corrosion resistance is no longer improved. On the other hand, if the Mg content exceeds 15 mass %, the oxidation of the coating bath becomes remarkable, and stable operation becomes difficult. Therefore, the Mg content is set in the range of 6% to 15% from the viewpoint of obtaining excellent post-painting corrosion resistance and manufacturability of the coating layer. From the same viewpoint, the Mg content is preferably 7 mass % to 10 mass %.

Further, the coating bath contains Si in an amount of more than 7 mass % and 20 mass % or less. When the Si content is 7 mass % or less, there is a possibility that the above-described large-grained $Mg_2Si$ may not be formed reliably when the coating layer is solidified. On the other hand, when the Si content exceeds 20%, the $FeAl_3Si_2$ intermetallic compound to be reduced is generated in the interfacial alloy layer described later, causing the workability of the coating layer and the post-working corrosion resistance to deteriorate. Therefore, from the viewpoint of achieving both excellent post-painting corrosion resistance and post-working corrosion resistance, the Si content is set to more than 7 mass % and 20 mass % or less, preferably 7.5 mass % to 15 mass %, and more preferably 8 mass % to 10 mass %.

Furthermore, the composition of the coating bath preferably satisfies:

$$\mathrm{MIN}\{\mathrm{Si}\ \%\times([\mathrm{Mg_2Si}]_{mol}/[\mathrm{Si}]_{mol}),\mathrm{Mg}\ \%\times([\mathrm{Mg_2Si}]_{mol}/(2\times[\mathrm{Mg}]_{mol}))\}/\mathrm{Al}\ \%>0.13, \quad \text{Expression (1):}$$

where M % M % denotes a concentration by mass % of element M in the coating bath, $[M]_{mol}$ denotes a molar mass of element M in the coating bath, and MIN(a, b) denotes any one of a and b, whichever is smaller.

The eutectic point of the Al—$Mg_2Si$ pseudo binary system in the coating layer is at the point of 86.1% Al-13.9% $Mg_2Si$ by mass %, and large-grained $Mg_2Si$ can be caused to precipitate in the coating layer by making $Mg_2Si$ excessive in the coating layer. However, since Al is also consumed when forming the interfacial alloy layer, the bath composition for obtaining the eutectic coating layer is at the point of approximately 88.5% Al-11.5% $Mg_2Si$. At this time, $Mg_2Si$ %/Al % is 0.13 (=11.5/88.5), and when the $Mg_2Si$ %/Al % in the bath becomes larger than this value, large-grained $Mg_2Si$ can be precipitated in the coating layer. The calculated maximum $Mg_2Si$ % formed of Mg and Si in the coating layer is determined by the number of moles of Mg and the number of moles of Si, and is determined as Si %×($[Mg_2Si]_{mol}/[Si]_{mol}$), since Mg is excessive when the number of moles of Mg exceeds twice the number of moles of Si. Similarly, since Si is excessive when twice the number of moles of Si is less than the number of moles of Mg, the maximum calculated $Mg_2Si$ % formed of Mg and Si in the coating layer is determined as Mg %×($[Mg_2Si]_{mol}/(2\times[Mg]_{mol})$).

From the above, in consideration of the case where either Mg or Si becomes excessive, the calculated $Mg_2Si$ % can be expressed as: MIN{Si %×($[Mg_2Si]_{mol}/[Si]_{mol}$), Mg %×($[Mg_2Si]_{mol}/(2\times[Mg]_{mol})$)}. In view of the above, it is preferable that the composition of the coating bath satisfies the above Expression (1) and the following Expression (2):

$$\mathrm{MIN}\{\mathrm{Si}\ \%\times([\mathrm{Mg_2Si}]_{mol}/[\mathrm{Si}]_{mol}),\mathrm{Mg}\ \%\times([\mathrm{Mg_2Si}]_{mol}/(2\times[\mathrm{Mg}]_{mol}))\}/\mathrm{Al}\ \%>0.15. \quad \text{Expression (2):}$$

Furthermore, the coating bath can also contain 0.01 mass % to 1 mass % of Fe. Fe is an element contained in the coating bath as a result of Fe dissolved out of the base steel sheet being incorporated into the coating bath when forming the coating layer. The upper limit for the content is 1 mass %, in consideration of the relation of the saturated dissolution amount of Fe in the coating bath.

The coating bath also contains Mn in an amount of more than 0.5 mass % and 2.5 mass % or less. Mn forms a solute in α-AlFeSi which is a compound contained in the interfacial alloy layer or the coating layer to form α-Al(Fe, Mn)Si. Since α-AlFeSi exhibits a potential nobler than those of Fe and Al, it functions as a local cathode during corrosion of the coating layer, and as its volume fraction increases, the corrosion of the coating layer is accelerated. On the other hand, it is known that α-Al(Fe, Mn)Si in which Mn forms a solute exhibits a much less noble potential than α-AlFeSi. In addition, part of Mn forms a solute in the α-Al phase, and the potential of α-Al in which Mn forms a solute becomes more noble. That is, the anode involved in the corrosion of the coating layer becomes more noble due to the formation of a solute of Mn. Therefore, by adding Mn to the Al alloy coating having the interfacial alloy layer, the potential difference between the anode and the cathode during corrosion is reduced, and the corrosion rate is lowered.

The content of Mn in the coating bath is more than 0.5 mass % and 2.5 mass % or less, preferably 0.5 mass % to 2.0 mass %, and more preferably 0.8 mass % to 1.2 mass %. When the Mn content is 0.5 mass % or less, the amount of Mn taken into the interfacial alloy layer is so small that sufficient workability and working corrosion resistance may not be obtained. The upper limit for the Mn content is 2.5 mass % in view of the saturated solubility of Mn in the coating bath.

Further, in the hot-dip Al alloy coated steel sheet disclosed herein, the ratio of the Mg content to the Mn content in the coating bath is important from the viewpoint of achieving both post-painting corrosion resistance and post-working corrosion resistance at a high level. Specifically, the ratio of the content by mass % of Mn to the content by mass % of Mg (Mn content/Mg content) in the coating bath is preferably 0.003 to 0.3, more preferably 0.03 to 0.3, and particularly preferably 0.1 to 0.3. If the ratio of the content of Mn to the content of Mg in the coating bath is less than 0.003, the amount of Mn taken into the interfacial alloy layer is not sufficient, and there is a possibility that sufficient post-working corrosion resistance can not be obtained. On the other hand, when the ratio of the Mn content to the Mg content in the coating bath exceeds 0.3, large-grained $Mg_2Si$ can not be sufficiently formed, and the post-painting corrosion resistance may be deteriorated.

Further, the coating bath contains Al in addition to the above-described Mg, Si, and Mn. The content of Al, which is a main component of the coating bath, is preferably 50 mass % or more, more preferably more than 75 mass %, and still more preferably more than 80 mass %, from the viewpoint of the balance between the corrosion resistance and the operation.

Further, the thickness of the coating of the hot-dip Al alloy coated steel sheet disclosed herein is preferably 10 μm to 35 μm per side. When the thickness of the coating is 10 μm or more, excellent corrosion resistance can be obtained, and when the thickness of the coating is 35 μm or less, excellent workability can be obtained. The thickness of the coating is preferably 12 μm to 30 μm, and more preferably 14 μm to 25 μm from the viewpoint of obtaining better corrosion resistance and workability. Further, the thickness of the coating is more preferably 15 μm or more, considering that the hot-dip Al alloy coated steel sheet disclosed herein forms large-grained $Mg_2Si$.

Note that the coating also contains base steel sheet components taken from the base steel sheet into the coating due to the reaction between the coating bath and the base steel sheet during the coating process, and inevitable impurities in the coating bath. The base steel sheet components taken into the coating include about several percent to several tens percent of Fe. Examples of the inevitable impurities in the coating bath include Fe, Cr, Cu, Mo, Ni, and Zr. Regarding Fe in the coating, it is not possible to quantify those taken from the base steel sheet separately from those in the coating bath. The total content of inevitable impurities is not particularly limited, yet from the viewpoint of maintaining the corrosion resistance and uniform solubility of the coating, the amount of inevitable impurities excluding Fe is preferably 1 mass % or less in total.

The coating bath may also contain at least one selected from Ca, Sr, V, Cr, Mo, Ti, Ni, Co, Sb, Zr, and B (hereinafter also referred to as an "optionally contained element"), apart from the above-mentioned inevitable impurities, as long as the effects of the present disclosure are not impaired. However, from the viewpoint of more reliably obtaining large-grained $Mg_2Si$, it is preferable that these optional elements are not contained in the coating. These elements react with Al, Fe, or Si to form an intermetallic compound to form nucleation sites, which may inhibit the formation of large-grained $Mg_2Si$.

Furthermore, the hot-dip Al alloy coated steel sheet disclosed herein may further be provided with a chemical conversion layer on its surface. The type of the chemical conversion layer is not particularly limited, and chromate-free chemical conversion treatment, chromate-containing chemical conversion treatment, zinc phosphate-containing chemical conversion treatment, zirconium oxide chemical conversion treatment, and the like are usable. The chemical conversion layer preferably contains: silica fine particles in terms of ensuring good adhesion properties and good corrosion resistance; and phosphoric acid and/or phosphate compound in terms of ensuring good corrosion resistance. Although any of wet silica and dry silica may be used as the silica fine particles, it is more preferable to contain fine silica particles having a high adhesion improving effect, in particular dry silica. Examples of the phosphoric acid and the phosphate compound include those containing one or more selected from orthophosphoric acid, pyrophosphoric acid, polyphosphoric acid, and metal salts or compounds thereof.

Furthermore, the hot-dip Al alloy coated steel sheet disclosed herein may further comprise a painting layer on its surface or the chemical conversion treatment layer.

The paint used to form the painting layer is not particularly limited. For example, polyester resin, amino resin, epoxy resin, acrylic resin, urethane resin, fluorine resin, and the like are usable. The method of applying the paint is not limited to a specific coating method, and examples thereof include a roll coater, a bar coater, a spray, curtain flow, and electrodeposition.

The base steel sheet used for the hot-dip Al alloy coated steel sheet disclosed herein is not particularly limited, and not only steel sheets similar to those used for ordinary hot-dip Al alloy coated steel sheets but also high-tensile steel sheets and the like are usable. For example, a hot rolled steel sheet or steel strip subjected to acid pickling descaling, or a cold rolled steel sheet or steel strip obtained by cold rolling them may be used.

(Method of Producing a Hot-Dip Al Alloy Coated Steel Sheet)

Then, a method of producing a coated steel sheet according to the present disclosure will be described below.

The method of producing a hot-dip Al alloy coated steel sheet according to the present disclosure comprises using a coating bath in a coating apparatus containing Mg: 6 mass % to 15 mass %, Si: more than 7 mass % and 20 mass % or less, and Mn: more than 0.5 mass % and 2.5 mass % or less, with the balance being Al and inevitable impurities.

According to this production method, it is possible to produce a hot-dip Al alloy coated steel sheet which has normal corrosion resistance and which is excellent in post-painting corrosion resistance and post-working corrosion resistance.

Although there is no particular limitation on the method of producing a hot-dip Al alloy coated steel sheet according to the present disclosure, a production method using a continuous hot-dip coating line is usually employed. In this method, since the base steel sheet is dipped in the coating bath to perform coating, coating is applied on both surfaces of the steel sheet.

There is no particular limitation on the type of the base steel sheet used for the hot-dip Al alloy coated steel sheet disclosed herein. For example, a hot rolled steel sheet or steel strip subjected to acid pickling descaling, or a cold rolled steel sheet or steel strip obtained by cold rolling them may be used.

Further, conditions of the pretreatment process and the annealing process are not particularly limited, and any method may be adopted.

The hot rolling process may be carried out according to the conventional method including slab heating, rough rolling, finish rolling, and coiling. Heating temperature, finish rolling temperature, and the like are not particularly restricted, either, and the conventionally used temperatures are applicable thereto.

The pickling process after the hot rolling may also be carried out according to the conventional method, and examples thereof include rinsing with hydrochloric acid or sulfuric acid.

The cold rolling process after the pickling is not particularly restricted, either, and may be carried out, e.g., at a reduction rate in the range of 30% to 90%. The reduction rate equal to or higher than 30% reliably prevents deterioration of the mechanical properties of the resulting steel sheet, and the rolling reduction rate not exceeding 90% reliably curtails rolling cost within a reasonable range.

The recrystallization annealing process can be carried out, for example, by: cleaning the steel sheet through degreasing and the like; and heating the steel sheet thus cleaned to a predetermined temperature in a heating zone and then subjecting the steel sheet to a predetermined thermal treatment in a subsequent soaking zone in an annealing furnace. It is preferred to process at temperature conditions in which the required mechanical properties are obtained. The annealing process is to be carried out in the annealing furnace under an atmosphere capable of reducing Fe, such that a surface layer of the steel sheet prior to the coating process is activated. Type of a reducing gas is not particularly restricted but a known reducing gas atmosphere conventionally in use is preferable for use in the present disclosure.

The coating bath used in the method of producing a hot-dip Al alloy coated steel sheet disclosed herein contains Mg: 6 mass % to 15 mass %, Si: more than 7 mass % and 20 mass % or less, and Mn: more than 0.5 mass % and 2.5 mass % or less.

Note that the coating bath may also contain Fe in an amount of about 0.01 mass % to 1 mass %. Note that the inevitable impurities and optionally contained elements are as described above in conjunction with the hot-dip Al alloy coated steel sheet according to the present disclosure.

Note that the temperature of the coating bath is preferably in the range of (the solidification start temperature+20° C.) to 700° C. The lower limit for the bath temperature is set at (the solidification start temperature+20° C.) in order to prevent the local solidification of the components resulting from a local bath temperature decrease in the coating bath by setting the bath temperature at or above the solidification point of the coating material such that the bath temperature is equal to (the solidification start temperature+20° C.) in performing hot-dip coating treatment. On the other hand, the upper limit for the bath temperature is set at 700° C. because if the bath temperature exceeds 700° C., rapid cooling of the coating becomes difficult, leading to an increase in the thickness of an interfacial alloy layer mainly composed of Al—Fe that is formed at the interface between the coating and the steel sheet.

Further, the temperature of the base steel sheet entering the coating bath (entering sheet temperature) is not particularly limited, yet from the viewpoint of securing proper coating characteristics in continuous hot-dip coating operation and preventing the change of the bath temperature, it is preferable to control within ±20° C. in relation to the temperature of the coating bath.

The time during which the base steel sheet is immersed in the coating bath is preferably 0.5 seconds or more. The immersion time shorter than 0.5 second may result in insufficient formation of the coating layer on a surface of the base steel sheet. On the other hand, the upper limit for the immersion time is not particularly limited, yet as the immersion time is increased, the thickness of the Al—Fe alloy layer formed between the coating layer and the steel sheet may increase. Therefore, the upper limit is preferably about 5 seconds.

The conditions for immersion of the base steel sheet in the coating bath are not particularly limited. For example, the line speed may be set to about 150 mpm to about 230 mpm when a mild steel sheet is subjected to coating, or to about 40 mpm when a thick steel plate is subjected to coating. The length to be immersed, of the steel material, may be about 5 m to about 7 m.

In the method of producing a hot-dip Al alloy coated steel sheet disclosed herein, after passed through the coating bath and subjected to the hot-dip coating, the steel sheet is preferably cooled at a cooling rate of less than 15 K/s.

By performing a mild cooling process of less than 15 K/s after the hot-dip coating using the above-mentioned coating bath, $Mg_2Si$ having a larger major axis length of more than 5 μm can be formed during the coating process. Furthermore, it is also possible to reduce the thickness of the interfacial alloy layer formed at the interface with the steel sheet for coating.

On the other hand, if the cooling rate is less than 5 K/s, the solidification of the coating is slow to cause a sagging pattern on the coating surface, causing a noticeable deterioration in appearance and a decrease in the conversion treatment property. Therefore, the cooling rate is preferably 5 K/s or more.

From the same viewpoint, the cooling rate is particularly preferably 8 K/s to 12 K/s.

In the method of producing a hot-dip Al alloy coated steel sheet disclosed herein, it is preferable to use nitrogen gas cooling for the cooling process. The reason for adopting the nitrogen gas cooling is that it is not necessary to extremely increase the cooling rate as described above, and the nitrogen gas cooling is economical because it does not require a large-scale cooling apparatus.

In the method of producing a hot-dip Al alloy coated steel sheet described herein, the conditions other than those for the coating bath and the hot-dip coating are not particularly limited, and a hot-dip Al alloy coated steel sheet may be produced according to any conventional method. For example, it is also possible to provide a chemical conversion treatment layer on a surface of a hot-dip Al alloy coated steel sheet (chemical conversion treatment step) or to separately provide a painting layer on the surface in a painting apparatus (painting layer formation step).

EXAMPLES

The present disclosure will be described with reference to examples.

(Samples 1 to 24)

For all hot-dip Al alloy coated steel sheets as samples, cold rolled steel sheets with a thickness of 0.8 mm produced by a conventional method were used as the base steel sheets, and hot-dip Al alloy coated steel sheets as samples were produced by changing the composition of the coating bath to various conditions while setting the bath temperature of the coating bath to 670° C., the entry temperature to 670° C., the line speed to 200 mpm, and the immersion time to 2 seconds in a hot-dip coating apparatus.

As for the composition of the coating bath, about 2 g was collected from the coating bath used for manufacture of a sample, and the bath composition was checked by chemical analysis. The composition of the coating bath for each sample is listed in Table 1. The balance of the coating bath is Al and inevitable impurities.

The cooling rate for the cooling with nitrogen gas after immersion in the coating bath is listed in Table 1.

In addition, the thickness of the coating was determined by averaging the results of measuring the distance from the base steel sheet to the coating surface at ten arbitrary locations in each sample using an electromagnetic induction type film thickness meter. The thickness of the coating obtained by this method includes the thickness of the interfacial alloy layer. The thickness of the coating for each sample is listed in Table 1.

Moreover, as for the composition of the interfacial alloy layer, arbitrary three cross sections were cut out from the hot-dip Al alloy coated steel sheet of each sample by shear working, and the average of semi-quantitative analysis values measured by EDX at arbitrary five points in the interfacial alloy layer was used. The composition of the interfacial alloy layer for each sample is listed in Table 1.

Furthermore, in each cross section cut out by the shear working, a cross section in the thickness direction of the coating layer was observed in the range of 1 mm in the sheet transverse direction with a scanning electron microscope (SEM), and the major axis length of $Mg_2Si$ in the coating layer was measured. The major axis length of $Mg_2Si$ for each sample is listed in Table 1.

(Evaluation)

Each of the obtained samples was evaluated as follows.

(1) Evaluation of Post-Painting Corrosion Resistance

Each sample of the hot-dip Al alloy coated steel sheet was sheared to a size of 80 mm×70 mm, subjected to a zinc phosphate treatment as a chemical conversion treatment in the same manner as in painting treatment for automobile outer plates, and then subjected to electrodeposition painting. Here, the zinc phosphate treatment and the electrodeposition painting were performed under the following conditions.

Zinc phosphate treatment: Using a degreasing agent, FC-E 2001 manufactured by Nihon Parkerizing Co., Ltd., a surface conditioner, PL-X, and a chemical conversion treatment agent, PB-AX 35 (temperature: 35° C.), the chemical conversion treatment was performed under the conditions of the concentration of free fluorine in the chemical conversion solution of 200 mass ppm, and the immersion time of the chemical conversion treatment solution of 120 seconds.

Electrodeposition painting: Electrodeposition painting was applied to obtain a layer thickness of 15 μm using GT-100 manufactured by Kansai Paint Co., Ltd.

Figure 2:
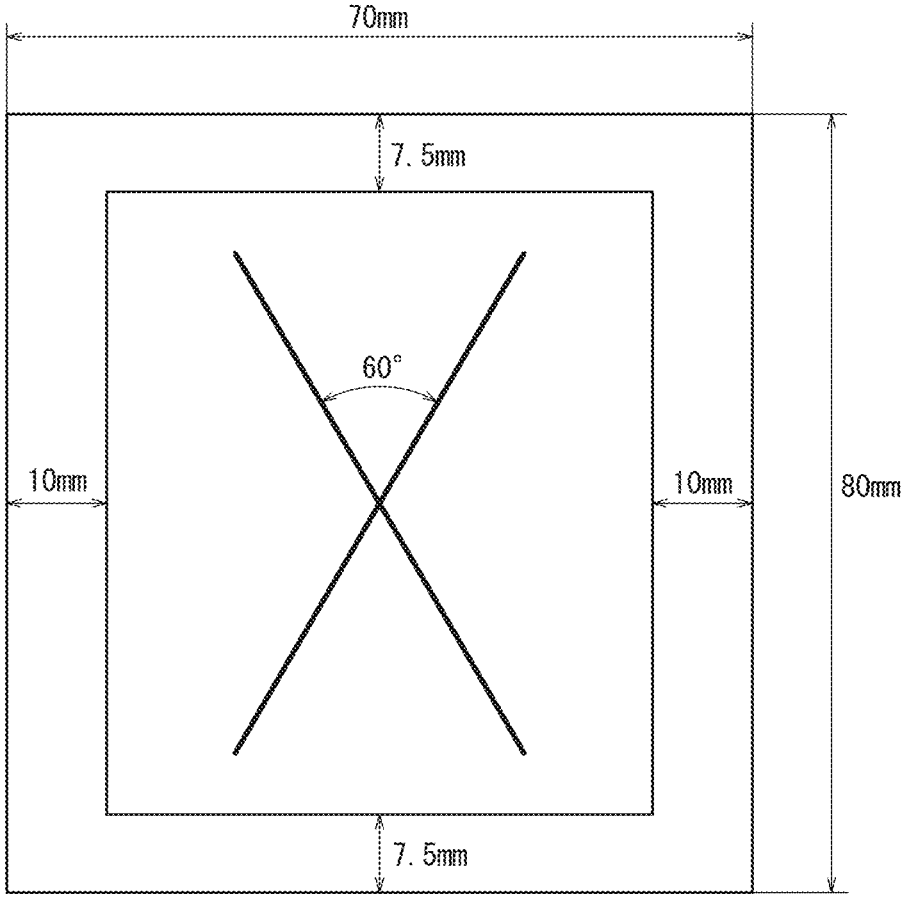
FIG. 2 is a diagram illustrating a sample for evaluation of post-painting corrosion resistance in examples.

After the chemical conversion treatment and the electrodeposition painting, as illustrated in FIG. 2, the ends of the evaluation surface by 7.5 mm and the non-evaluation surface (rear surface) were sealed with a tape, and then using a cutter knife, a cross-cut scratch with a length of 60 mm and a central angle of 60° was made on the coated steel sheet at the center of the evaluation surface to a depth of reaching the base steel sheet of the coated steel sheet, and the resulting coated steel sheet was used as a sample for evaluation of post-painting corrosion resistance.

Figure 3:
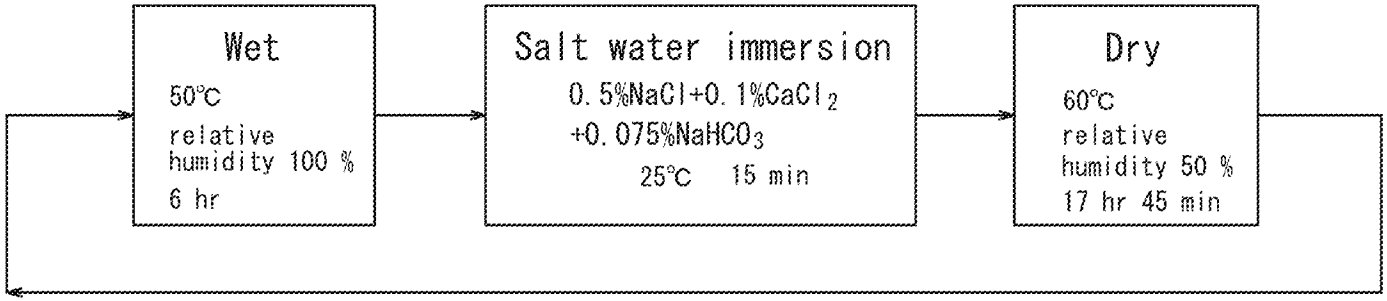
FIG. 3 is a diagram illustrating a cycle of accelerated corrosion test in examples.

Using the above evaluation samples, accelerated corrosion test was performed in the cycle illustrated in FIG. 3. The accelerated corrosion test started from a wet condition, and after 60 cycles, the painting layer blister width at the part where the coating layer blister originating from the scratch was the largest (maximum painting layer blister width, which is the maximum painting layer blister width on one side across the scratch) was measured, and the post-painting corrosion resistance was evaluated based on the following criteria. The evaluation results are listed in Table 1.

Excellent: maximum painting layer blister width≤1.0 mm

Good: 1.0 mm<maximum painting layer blister width≤1.5 mm

Fair: 1.5 mm<maximum painting layer blister width≤2.0 mm

Poor: maximum painting layer blister width>2.0 mm (2) Evaluation of Post-Bending Corrosion Resistance For each hot-dip Al alloy coated steel sheet sample without painting, a 180° bending (4T bending) was applied with four sample sheets of the same thickness sandwiched inside, and in accordance with JIS Z2371-2000, salt spray test was conducted on the outside of the bent portion. The time required until red rust generated in each sample was measured, and evaluated based on the following criteria. The evaluation results are listed in Table 1.

Good: red rusting time≥4000 hours

Fair: 3500 hours≤red rusting time<4000 hours

Poor red rusting time<3500 hours (3) Evaluation of Bending-Back Workability

After sheared to a size of 30 mm×230 mm, each hot-dip Al alloy coated steel sheet sample without painting was subjected to a drawing process between draw bead molds (round bead: convex R of 4 mm and shoulder R of 0.5 mm, material: SKD11) under a set of conditions including a holding load of 500 kg and a drawing speed of 200 mm/min. After the process, the bead side surface was observed with a scanning electron microscope (SEM), and after measuring the maximum width of arbitrary 10 cracks in 2 locations in the field of view of 500×, 240 μm×320 μm, an average was calculated. The average values of the maximum crack widths were evaluated based on the following criteria. The evaluation demonstrates that the smaller the maximum crack width, the better the bend-back workability. The evaluation results are listed in Table 1.

Good: maximum crack width≤20 μm

Fair: 20 μm<maximum crack width≤25 μm×:maximum crack width>25 μm (4) Evaluation of Corrosion Resistance at Painted Portion For each hot-dip Al alloy coated steel sheet sample without painting, the same chemical conversion treatment and electrodeposition coating as in the above section (1) Evaluation of Post-painting Corrosion Resistance were performed on the samples after subjection to the bending-back workability evaluation test described in the above section (3). Then, after sealing a non-evaluation surface (rear surface) with a tape, using a cutter knife, a scratch with a length of 60 mm was made at the center of the evaluation surface to a depth of reaching the base steel sheet of the coated steel sheet, and the resulting coated steel sheet was used as a sample for evaluation of the corrosion resistance at the painted portion.

Using the above samples for evaluation of the corrosion resistance at the painted portion, accelerated corrosion test was performed in the cycle illustrated in FIG. 3. The accelerated corrosion test started from a wet condition, and after 30 cycles, the painting layer blister width at the part where the painting layer blister originating from the scratch was the largest (maximum coating layer blister width, which is the maximum coating layer blister width on one side across the scratch) was measured, and the post-painting corrosion resistance was evaluated based on the following criteria. The evaluation results are illustrated in Table 1.

Excellent: maximum painting layer blister width≤2.0 mm

Good: 2.0 mm<maximum painting layer blister width≤4.0 mm

Fair: 4.0 mm≤maximum painting layer blister width≤5.0 mm

Poor: maximum painting layer blister width>5.0 mm

TABLE 1

| | Composition of coating layer (mass %) | | | | Value on the left side of Expression (1) | | Cooling rate after immersion in the coating bath | Compositon of interfacial alloy layer (mass %) | | | | | Major axis length of massive $Mg_2Si$ in the coating layer |
|---|---|---|---|---|---|---|---|---|---|---|---|---|---|
| No. | Si | Mg | Mn | Fe | ($Mg_2Si$ %)/Al % | Mn/Mg | (K/s) | Al | Si | Mg | Fe | Mn | (μm) |
| 1 | 4.6 | 7.1 | 0.0 | 0.5 | 0.126 | 0.002 | 10 | 72.7 | 6.6 | 1.3 | 19.4 | 0.0 | 0.0 |
| 2 | 4.1 | 7.1 | 0.9 | 0.5 | 0.126 | 0.126 | 10 | 63.3 | 5.9 | 1.5 | 20.5 | 8.8 | 0.0 |
| 3 | 4.0 | 7.3 | 1.3 | 0.5 | 0.127 | 0.183 | 10 | 61.8 | 6.8 | 0.7 | 13.8 | 16.9 | 0.0 |
| 4 | 8.3 | 7.9 | 0.0 | 0.5 | 0.147 | 0.000 | 10 | 69.1 | 9.5 | 1.1 | 20.3 | 0.0 | 10.8 |
| 5 | 8.4 | 7.2 | 0.6 | 0.5 | 0.134 | 0.083 | 10 | 60.1 | 9.8 | 0.9 | 21.6 | 7.7 | 10.0 |
| 6 | 8.2 | 7.1 | 0.9 | 0.5 | 0.133 | 0.123 | 10 | 55.6 | 9.8 | 0.9 | 23.8 | 9.9 | 9.5 |
| 7 | 7.6 | 7.1 | 1.2 | 0.5 | 0.131 | 0.169 | 5 | 57.8 | 7.9 | 0.0 | 24.3 | 10.0 | 18.4 |
| 8 | 7.6 | 7.1 | 1.2 | 0.5 | 0.131 | 0.169 | 10 | 62.1 | 3.6 | 2.0 | 23.5 | 8.8 | 5.1 |
| 9 | 7.6 | 7.1 | 1.2 | 0.5 | 0.131 | 0.169 | 10 | 58.0 | 8.6 | 0.2 | 17.8 | 15.4 | 8.7 |
| 10 | 7.6 | 7.1 | 1.2 | 0.5 | 0.131 | 0.169 | 10 | 73.6 | 6.5 | 4.0 | 14.8 | 1.1 | 8.6 |
| 11 | 7.6 | 7.1 | 1.2 | 0.5 | 0.131 | 0.169 | 10 | 65.6 | 12.2 | 2.2 | 18.2 | 1.8 | 9.1 |
| 12 | 7.6 | 7.1 | 1.2 | 0.5 | 0.131 | 0.169 | 10 | 56.1 | 6.4 | 0.4 | 20.9 | 16.2 | 9.4 |
| 13 | 7.6 | 7.1 | 1.2 | 0.5 | 0.131 | 0.169 | 20 | 59.7 | 16.4 | 0.6 | 14.8 | 16.7 | 5.1 |
| 14 | 7.6 | 7.1 | 1.2 | 0.5 | 0.131 | 0.169 | 50 | 59.7 | 5.1 | 0.4 | 13.9 | 8.4 | 2.9 |
| 15 | 6.2 | 10.3 | 0.0 | 0.5 | 0.192 | 0.001 | 10 | 72.9 | 3.9 | 2.0 | 21.2 | 0.0 | 14.4 |

TABLE 1-continued

| | | | | | | | | | | | | | |
|---|---|---|---|---|---|---|---|---|---|---|---|---|---|
| 16 | 5.8 | 10.0 | 0.7 | 0.01 | 0.185 | 0.070 | 10 | 63.1 | 4.6 | 2.1 | 21.1 | 9.1 | 13.4 |
| 17 | 5.8 | 10.4 | 1.1 | 1.0 | 0.194 | 0.105 | 10 | 62.5 | 2.0 | 1.5 | 17.6 | 16.4 | 6.0 |
| 18 | 8.0 | 14.1 | 0.7 | 0.5 | 0.285 | 0.050 | 10 | 59.6 | 7.3 | 2.8 | 19.6 | 10.7 | 5.2 |
| 19 | 16.2 | 7.1 | 0.8 | 0.5 | 0.146 | 0.113 | 10 | 61.0 | 10.2 | 1.1 | 19.3 | 8.5 | 5.5 |
| 20 | 10.2 | 9.9 | 1.1 | 0.5 | 0.196 | 0.111 | 10 | 62.7 | 8.1 | 1.8 | 18.2 | 9.3 | 5.2 |
| 21 | 18.1 | 14.4 | 0.8 | 0.5 | 0.337 | 0.056 | 10 | 49.9 | 16.9 | 3.5 | 20.5 | 8.9 | 11.5 |
| 22 | 14.4 | 12.3 | 0.7 | 0.5 | 0.264 | 0.057 | 10 | 54.8 | 13.8 | 2.7 | 20.6 | 7.8 | 9.4 |
| 23 | 8.1 | 4.2 | 0.8 | 0.5 | 0.075 | 0.190 | 10 | 61.9 | 8.7 | 0.0 | 20.5 | 8.9 | 0.0 |
| 24 | 10.1 | 0.0 | 1.1 | 0.5 | 0.000 | — | 10 | 57.2 | 10.3 | 0.0 | 20.3 | 12.2 | 0.0 |

| No. | Number of $Mg_2Si$ having a major axis length of 5 μm or more (counts) | Area ratio of $Mg_2Si$ (%) | Nearest neighbor distance betwen $Mg_2Si$ having a major axis length of 5 μm or more and the coating layer surface (μm) | Thickness of coating (μm) | Evaluation: Post-painting corrosion resistance | Post-bending corrosion resistance | Bending-back workability | Corrosion resistance at the painted portion | Remarks |
|---|---|---|---|---|---|---|---|---|---|
| 1 | 0 | 0 | — | 15 | Poor | Poor | Poor | Poor | Comparative example |
| 2 | 0 | 0 | — | 15 | Poor | Poor | Good | Poor | Comparative example |
| 3 | 0 | 0 | — | 15 | Poor | Poor | Good | Poor | Comparative example |
| 4 | 8 | 3 | 8 | 15 | Good | Poor | Poor | Poor | Comparative example |
| 5 | 9 | 3 | 7 | 15 | Excellent | Good | Good | Excellent | Example |
| 6 | 8 | 5 | 8 | 15 | Excellent | Good | Good | Excellent | Example |
| 7 | 15 | 15 | 0 | 15 | Good | Good | Good | Good | Example |
| 8 | 11 | 9 | 1 | 5 | Fair | Fair | Good | Fair | Example |
| 9 | 10 | 8 | 4 | 10 | Good | Good | Good | Good | Example |
| 10 | 11 | 5 | 6 | 15 | Excellent | Good | Good | Excellent | Example |
| 11 | 13 | 3 | 18 | 25 | Excellent | Good | Good | Excellent | Example |
| 12 | 11 | 2 | 33 | 40 | Excellent | Good | Fair | Excellent | Example |
| 13 | 7 | 3 | 6 | 15 | Good | Fair | Good | Fair | Example |
| 14 | 3 | 1 | 9 | 15 | Poor | Poor | Good | Poor | Comparative example |
| 15 | 9 | 5 | 5 | 15 | Good | Poor | Poor | Poor | Comparative example |
| 16 | 10 | 6 | 5 | 15 | Excellent | Good | Good | Excellent | Example |
| 17 | 10 | 6 | 4 | 15 | Excellent | Good | Good | Excellent | Example |
| 18 | 18 | 8 | 1 | 15 | Excellent | Good | Good | Excellent | Example |
| 19 | 7 | 3 | 3 | 15 | Excellent | Good | Good | Excellent | Example |
| 20 | 11 | 6 | 1 | 15 | Excellent | Good | Good | Excellent | Example |
| 21 | 15 | 8 | 1 | 15 | Excellent | Good | Good | Excellent | Example |
| 22 | 10 | 7 | 2 | 15 | Excellent | Good | Good | Excellent | Example |
| 23 | 0 | 0 | — | 15 | Poor | Poor | Good | Poor | Comparative example |
| 24 | 0 | 0 | — | 15 | Poor | Poor | Good | Poor | Comparative example |

It was found from Table 1 that each of the samples according to our examples is excellent in a well-balanced manner in any of post-painting corrosion resistance, post-bending corrosion resistance, bending workability, and corrosion resistance at the painted portion. In contrast, it was found that for each of the samples according to the comparative examples has a problem in one of the evaluation items (indicated by "Poor").

INDUSTRIAL APPLICABILITY

According to the present disclosure, it is possible to provide a hot-dip Al alloy coated steel sheet which are excellent in post-painting corrosion resistance and post-working corrosion resistance, and a method of producing the hot-dip Al alloy coated steel sheet.

REFERENCE SIGNS LIST

1 coating layer (portion other than $Mg_2Si$)
2 $Mg_2Si$
3 interfacial alloy layer

The invention claimed is:

1. A hot-dip Al alloy coated steel sheet comprising a coating formed by a coating layer and an interfacial alloy layer present at an interface between the coating layer and a base steel sheet, wherein the interfacial alloy layer has a chemical composition containing Mn: 5 mass % to 30 mass %, and the coating layer has a chemical composition containing Mg: 6 mass % to 15 mass %, Si: 7.5 mass % or more and 20 mass % or less, Mn: more than 0.5 mass % and 2.5 mass % or less, and optionally Fe: 0.01 to 1 mass % with the balance being Al and inevitable impurities, and the coating layer contains $Mg_2Si$ having a major axis length of 5 μm or more.

2. The hot-dip Al alloy coated steel sheet according to claim 1, wherein the interfacial alloy layer further contains Al, Fe, and Si.

3. The hot-dip Al alloy coated steel sheet according to claim 1, wherein the coating layer is formed using a coating bath in a coating apparatus containing Mg: 6 mass % to 15 mass %, Si: more than 7.5 mass % and 20 mass % or less, and Mn: more than 0.5 mass % and 2.5 mass % or less, with the balance being Al and inevitable impurities.

4. The hot-dip Al alloy coated steel sheet according to claim 3, wherein the coating layer is formed by passing the base steel sheet through the coating bath and then cooling the base steel sheet at a cooling rate of less than 15 K/s.

5. The hot-dip Al alloy coated steel sheet according to claim 3, wherein the coating bath has a composition that satisfies the following relationship:

$$\mathrm{MIN}\{\mathrm{Si}\ \%\times([\mathrm{Mg_2Si}]_{mol}/[\mathrm{Si}]_{mol}),\mathrm{Mg}\ \%\times([\mathrm{Mg_2Si}]_{mol}/(2\times[\mathrm{Mg}]_{mol}))\}/\mathrm{Al}\ \%>0.13, \quad \text{Expression (1):}$$

where M % denotes a concentration by mass % of element M, $[M]_{mol}$ denotes a molar mass of element M, and MIN(a, b) denotes any one of a and b, whichever is smaller.

6. The hot-dip Al alloy coated steel sheet according to claim 1, wherein the coating has a thickness of 10 μm to 35 μm.

* * * * *